United States Patent [19]

Talpo

[11] Patent Number: 4,577,073

[45] Date of Patent: Mar. 18, 1986

[54] ELECTRICAL CIRCUIT BREAKER WITH ARC EXTINGUISHING COMPRESSED FLUID

[75] Inventor: Gianpietro Talpo, Bergamo, Italy

[73] Assignee: Sace S.p.A. Costruzioni Elettromeccaniche, Bergamo, Italy

[21] Appl. No.: 691,015

[22] Filed: Jan. 14, 1985

[30] Foreign Application Priority Data

Jan. 20, 1984 [IT] Italy ..... 19264 A/84

[51] Int. Cl.[4] ..... H01H 33/88

[52] U.S. Cl. ..... 200/148 A; 200/148 R; 200/150 G

[58] Field of Search ..... 200/148 A, 148 R, 150 G

[56] References Cited

U.S. PATENT DOCUMENTS 2,933,575 4/1960 Baker ..... 200/148 A 4,112,276 9/1978 Cromer et al. ..... 200/148 A

*Primary Examiner*—Robert S. Macon

*Attorney, Agent, or Firm*—Diller, Ramik & Wight

[57] ABSTRACT

The present invention relates to an electrical circuit breaker with arc extinguishing compressed fluid, in which the compression of the extinguishing fluid is caused in a mixed way, by the pneumatic action of a compressing piston solid with the movable contacts of the circuit breaker and by pressure self-generation, following the action of the electrical arc, which decomposes and heats the fluid. This compression in a mixed form takes place within a chamber provided within a movable body assembled on the stationary contact of the circuit breaker and suitable to follow, under the action of elastic means, along a certain path, the opening stroke of the movable contacts, which bear a blasting nozzle, which during said stroke path connects a zone of compression of the fluid under the action of the piston with said chamber of the movable body, and which, after the detachment from the movable body because of its stopping, allows the escape of blasts of compressed fluid, both from said chamber and from the compression zone, directed against the arc to the purpose of extinguishing it.

8 Claims, 4 Drawing Figures

ELECTRICAL CIRCUIT BREAKER WITH ARC EXTINGUISHING COMPRESSED FLUID

Figure 1:
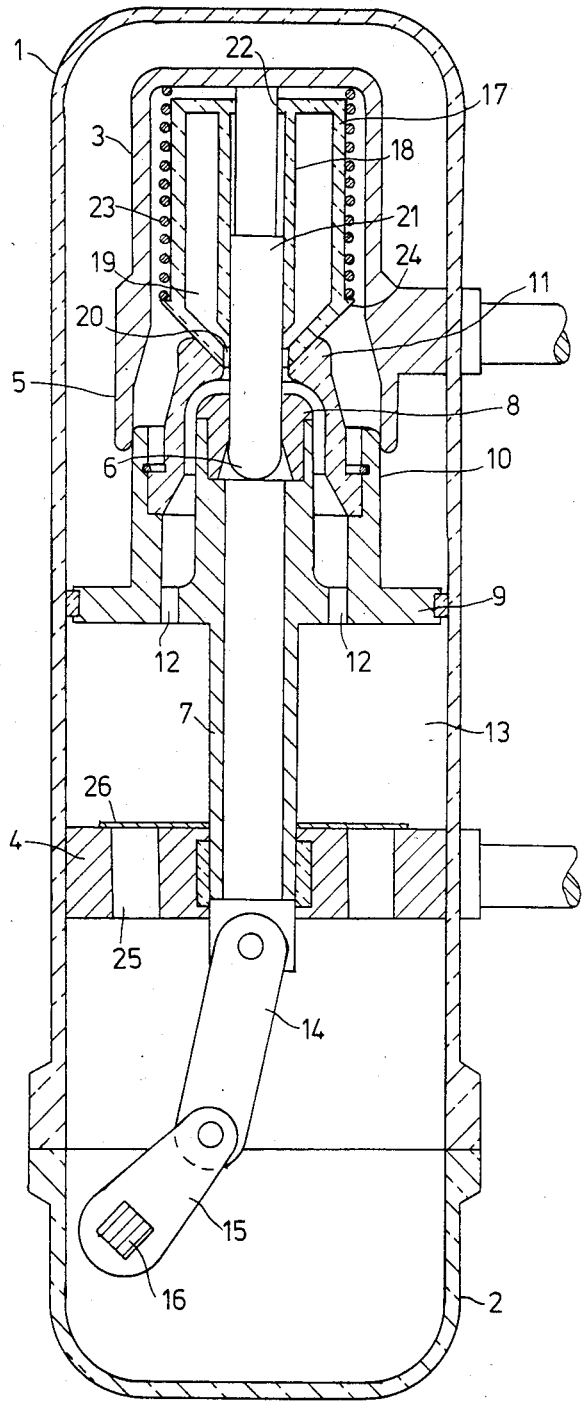

The object of the present invention is an electrical circuit breaker of the type using an arc extinguishing compressed fluid, in particular using a gas, such as sulphur hexafluoride.

A known circuit breaker of this type (see e.g. the German Patent Application DE-OS No. 2.140.284) comprises, inside a tightly sealed casing filled with the arc extinguishing fluid, a current bearing connection with a stationary contact, a current bearing connection in which a movable contact is guided, being actuated by a driving mechanism, a blasting device consisting of a piston solid with the movable contact and defining a compression zone, and of a blasting nozzle brought by the movable contact to an advanced position relatively to the stationary contact with its opening communicating with said compression zone, as well as a body for the closure of the blasting nozzle slidingly mounted for a limited stroke on the stationary contact under the action of a spring, and suitable to be shifted against the action of said spring by said blasting nozzle when the same is moved together with the movable contact from its position of "circuit breaker open" to its position of "circuit breaker closed".

With the movement of the movable contact and hence of the compressing piston and of the blasting nozzle, from the position of "circuit breaker closed" to the position of "circuit breaker open", the piston compresses the arc extinguishing fluid in the compressing zone inside the casing and in a first part of its stroke, said closing body, being urged by its spring, follows the movement of the movable contact keeping closed the blasting nozzle, and preventing the compressed fluid from escaping form the compression zone. Only after that said movable body has arrived to the end of its stroke, defined by a stop element, the blasting nozzle is got free and the compressed arc extinguishing fluid can flow through said nozzle from the compression zone, to direct an extinguishing blast against the arc, which in the mean time has been formed between the stationary contact and the movable contact, because of and after their separation. The extinction of the arc is thus carried out by means of a blast of compressed arc extinguishing fluid.

This known solution has some drawbacks.

First, it must be noted that, especially in the presence of high electrical currents to be interrupted, the counter-pression generated by the electrical arc following the breakdown and the heating of the arc extinguishing fluid in the compression zone inside the casing, conditions the movement of the movable contact and of the piston solid with it, so that the compensating of this counter-pressure, which is necessary in order to completing the opening stroke of the contacts, demands an increase of the mechanical energy available from the driving mechanism. One could think to reduce the diameter of the fluid compressing piston to the purpose of reducing this additional requirement of energy, but the consequent volume reduction causes all the differential pressure exchanges to take place between further reduced volumes, and hence the counter-pressure due to the arc would be proportionally increased, and the external energy required from the driving unit to the purpose of maintaining the necessary movement speed and of completing the foreseen opening stroke would be consequently further increased.

Moreover, as in the solution known both the stationary contact and the movable contact have been given a tubular shape for allowing the discharge of the gaseous stream, and as the movable contact bears a set of contact blades, the axial action of the gaseous stream which passes along the movable contact tends to shift the roots of the arc inside the tubular contact, with the consequent wear of the contact blades and of the main movable contact points.

Trying eliminating the above described drawbacks leads to a longer and wider structure of the pole, if suitable main contact are applied outside the piston, to the purpose of keeping them away from the zone of the arc, this being the presently currently used solution.

Purpose of the present invention is to provide an electrical circuit breaker of the type using an arc extinguishing compressed fluid as hereinbefore described, in which the extinguishment of the arc and hence the circuit breaking caused by the blast of the compressed extinguishing fluid takes place with higher safety and reliability, thanks to a higher energy made available for the extinguishment, and to a suitable orienting of the stream of compressed fluid against the arc stably positioned and conditioned as for its radial dimensions, and in which the mechanical energy requirement for the drive is limited, and the outside dimensions of the pole are reduced.

In order to achieving this purpose, according to the invention, an electrical circuit breaker is provided of the type as known from the DE-OS No. 2.140.284, in which the blasting nozzle closing body, slidingly mounted on the stationary contact and undergoing the action by a spring which tends to push it towards the free end of this contact up to a stop, is provided with a cavity open towards the blasting nozzle, so as to be in communication with the opening of the nozzle itself, and through said opening, with the compression zone, and to behave as a collecting chamber for the fluid compressed by the action of said piston, and after the formation of the arc, by the action of said arc.

The circuit breaker according to the invention, due to the providing of said chamber in the movable body, couples therefore with the system of pneumatic compression of the extinguishing fluid, the system of pressure self-generation by the action of the arc, and uses for quenching the arc itself the total energy accumulated in the collecting chamber, as a more efficient blast.

By means of a suitable and variable shaping of the outlet of said chamber provided in the movable body, and of the cooperating outlet of the opening of the blasting nozzle, a conditioning can be obtained of the radial dimensions of the arc for certain values of the electrical current, with a containment effect of the energy developed by the arc, the positioning stability can be obtained of the arc between the two contacts, inside the zone in which the arc is developed, a suitable orienting can be obtained of the generated and compressed gas stream relatively to the arc, and the subduing is obtained of both arc roots to concentrated fluid blast specific actions.

Of course, the chamber provided in the movable body and the blasting volumes must be suitably and correctly dimensioned to the purpose of achieving in the first part of the contact opening stroke, i.e., before the arc is formed due to the circuit opening, a reduction of the mechanical energy required from the driving unit and of exploiting later on, and precisely from the arc formation time on, in the most suitable way, the additional pressure generated by the arc in the chamber of the movable body.

The presence of said chamber in the movable body allows also the compression piston diameter to be reduced without decreasing the efficiency of the arc extinguishing action, thanks to the taking advantage of the pressure surge generated by the decomposition and of the heating of the extinguishing fluid in the chamber of the movable body due to the effect of the electrical arc.

In a preferred embodiment of the circuit breaker according to the invention, main contacts are provided, which are per se known, positioned in an area outside the nozzle and outside the chamber of the movable body, said main contacts being completely separated and independent from the arc contacts on which the movable body and the blasting nozzle are provided, their current bearing function being thus not impaired by the arc.

Figure 2:
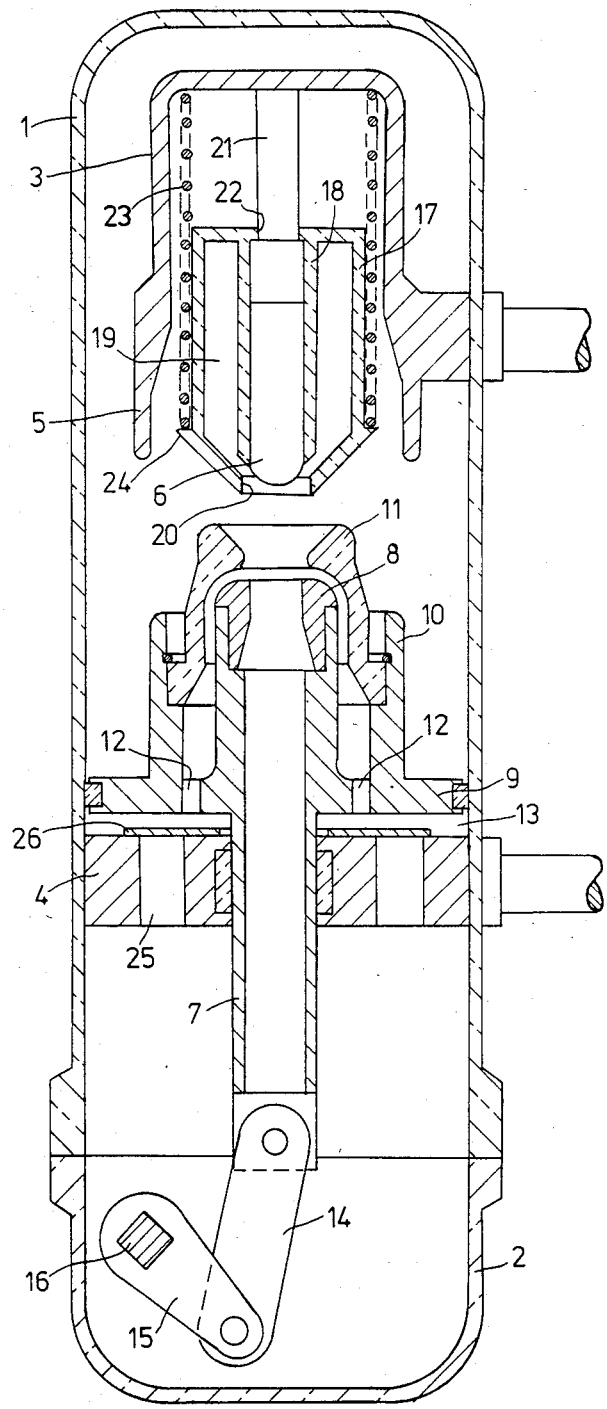
Figure 3:
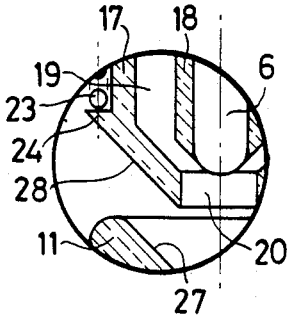
Figure 4:
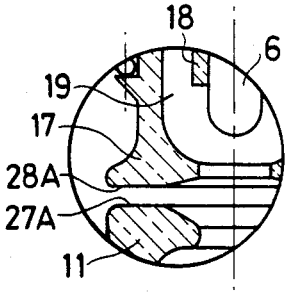

The circuit breaker according to the invention is being disclosed hereinunder in greater detail, with reference to the attached drawings, which illustrate an exemplifying embodiment of it, and some structural alternatives of a detail of it. In particular, FIGS. 1 and 2 show an axial section of the circuit breaker respectively in the "closed" and "open" positions, FIG. 3 shows on an enlarged scale a detail of the circuit breaker of FIGS. 1 and 2, and FIG. 4 shows an alternative structure of the detail shown in FIG. 3.

In the drawings only a single pole is shown of an electrical circuit breaker, which may be either unipolar or multipolar. In this latter case, it is intended that each pole of the circuit breaker has the same structure as the one illustrated and disclosed hereinunder.

The pole of the circuit breaker comprises an insulating casing 1, tightly sealed in its lower part by a box 2. The casing 1 contains an extinguishing fluid, in particular a gas, such as sulphur hexafluoride and is provided with current bearing connections 3 and 4. The upper connection 3 has the shape of a cup turned upside down, open downwards, and supports the main stationary contacts 5 and in its centre position a stationary rod shaped arc contact 6. In the lower connection 4 a tubular stem 7 is supported and guided by means of a set of sliding blades, such stem being provided in its upper part with a movable arc contact 8 and with which a compression piston 9 being solid, which is tightly guided inside the cylindrical insulating casing 1. Onto the piston 9 the main movable contacts 10 are applied for cooperating with the main stationary contacts 5. These main movable contacts 10 support inside themselves a blasting nozzle 11 of insulating material, said nozzle surrounding the free end of the tubular stem 7 with the movable arc contact 8, and protruding beyond this movable arc contact towards the stationary arc contact 6 (considering the opening position shown in FIG. 2). It is to be noted that the movable arc contact 8 is capable of slidingly engaging the rod shaped stationary arc contact 6, whilst the lowest diameter of the opening of the blasting nozzle 11 is greater than the outer diameter of the rod shaped stationary arc contact 6, so that, also in the "closed" position of the contacts, as shown in FIG. 1, an annular passage remains free around the rod shaped stationary arc contact 6, towards the space defined between the nozzle 11 and the free end of the tubular stem 7 supporting the movable arc contact 8. This space, in its turn, communicates, through bores 12 provided in the piston 9, with a compression zone 13 defined inside the casing 1 between the piston 13 and the lower connection 4, said lower connection showing a set of through bores 25 which can be closed by blade valves 26, through said bores being it possible to fill the compression zone 13 with arc extinguishing gas coming from the lower portion of the casing 1 when the piston 9 carries out the stroke corresponding to the closure movement of the contacts (upwards in FIG. 2), whilst during the opposite movement of the piston 9 the valves 26 are closed, thus isolating the compression zone 13.

The tubular stem 7 is linked at its lower end, through an insulating connecting rod 14 and a metal lever 15 to a shaft 16 of a driving mechanism, such shaft extending outside the gas tight casing 1.

On the rod shaped stationary arc contact 6, inside the cup forming the upper connection 3, a hollow body 17 is slidingly mounted of insulating material, which is provided in its inside with a guide sleeve 18, between which and the outer wall of the body an annular closed chamber 19 is formed, provided in its lower part with an opening 20 whose diameter is greater than the outer diameter of the rod shaped stationary arc contact 6. On this latter, a stop shoulder 21 is provided, with which an inner collar 22 of the guide sleeve 18 can cooperate for limiting the shift stroke of the body 17, under the thrust by a spring 23 acting between an annular outer shoulder 24 of the body, and the bottom of the cup forming the upper connection 3.

In the "opening" position of the contacts (FIG. 2) the body 17 is therefore moved downwards down to the stopping of the collar 22 against the shoulder 21, whilst the movement to the "closure" position of the movable assembly formed by the stem 7, the movable arc contact 8, the piston 9, the main movable contacts 10 and the blasting nozzle 11, causes, starting from a certain point during the stroke, in which the nozzle 11 leans against the lower end of the body 17, the shift of this latter too, against the action of the spring 23.

It must be observed that, throughout the time during which the nozzle 11 remains in its leaning position against the body 17, the opening of the same nozzle is closed towards the outside, it being in communication through the opening 20 with the chamber 19 of the body 17.

The operating way of the circuit breaker disclosed is as follows.

During the opening stroke of the movable assembly, starting from the position shown in FIG. 1, the piston 9 compresses the gas in the compression zone 13 communicating with the chamber 19 of the movable body 17, which chamber therefore collects compressed gas. In this first stage of mechanical compression, the presence of the volume of chamber 19 reduces the value of the pressure generated by the piston, and hence the mechanical energy required from the driving unit, which is controlled by the dimensions of the chamber 19.

At the separation time of the arc contacts 6 and 8, an arc is ignited between them which breaks down and heats the gas, increasing the pressure of the gas collected inside the chamber 19. At the beginning of arc ignition indeed the nozzle 11 is still leaning against the lower end of the movable body 17. Subsequently, the stroke of the body is stopped by the shoulder 21 and the nozzle 11 separates from said body during the further opening stroke of the movable assembly, allowing the starting of the discharge of the compressed gas from the chamber 19 through the opening 20 towards the nozzle. The presence of the arc however conditions the discharge law of the gas collected in the chamber 19 until the electrical current passes through its zero value.

During the time lag which elapses, with the arc being already igniting, between the separation of the nozzle 11 from the movable body 17 and the passage of the electrical current through the zero value, the pressure surge generated by the arc due to the breakdown and the heating of the gas is distributed partly inside the chamber 19 of the movable body 17 and partly in the compression zone 13, and therefore the braking action of this pressure surge on the piston solid with the movable assembly is of limited value, and delayed in time.

When the electrical current passes through the zero value, an efficient and powerful blast is available, which extinguishes the arc and causes therefore the circuit breaking.

By means of the solution provided according to the invention, it is possible to reduce the amount of gas pumped by the piston for quenching the arc, and to reduce the mechanical energy required from the driving unit for the manoeuvre because of the additional pressure increase generated by the decomposition and the heating of the gas in the presence of the arc. It is also possible to reduce the diameter of the compressing piston, without reducing the performance of the circuit breaker.

The pressure surge generated by the arc and counteracting the compressing piston can also be reduced by intervening on the opening or bore of the blasting nozzle, increasing its diameter, with its extinguishing efficiency being not impaired, in that the fluid blast and pressure contribution of the movable body chamber is taken advantage of.

The radial dimensions of the arc for particular values of electrical current to be interrupted are suitably conditioned with a containment affect of the energy developed by the arc. Moreover, a stability is obtained of positioning of the arc between the two arc contacts inside the zone inside which the arc develops.

The configuration of the lower end of the movable body and of the blasting nozzle can be varied as for its shape, as well as for its dimensions, to the purpose of obtaining specific effects.

When the inner surface 27 of the opening or bore of the blasting nozzle 11 is divergent, as it is shown in detail in FIG. 3 and the outer end surface 28 of the movable body 17 destined to cooperate with the inner surface 27 of the opening of the nozzle 11 is convergent, the fluid blasting action on the arc results to be prevailigly directed in the axial sense and determines a gradual quenching of the arc.

When on the contrary the cooperating surfaces 27A and 28A of the nozzle 11 and respectively of the movable body 17 are perpendicular to the axis of the nozzle, as it is shown in FIG. 4, the action of the fluid blast on the arc is directed in the radial sense, and determines an abrupt quenching of the arc. Moreover, the holding is obtained of the arc within a limited zone. This effect can be further improved by making shorter the guide sleeve 18 inside the body 17.

It must be moreover observed that the shoulder 21 which limits the stroke of the movable hollow body 17 under the thrust by the spring 23 can be placed in different positions along the stationary arc contact 6, so as to define, at the end of said stroke of the movable body, different relative positionings between the end of the stationary arc contact 6 and the end of the movable body 17. As it can be seen from a comparison between FIGS. 3 and 4, in the first case the end of the stationary arc contact 6 practically reaches the opening 20 of the body 17, whilst in the second case said end is spaced apart from said opening and therefore completely enclosed within the chamber 19, a further improvement of the constraining effect of the arc within a limited zone, in particular in case of high currents, and hence a better exploitation of the volume interested by the energy of the arc being obtained.

I claim:

1. Electrical circuit breaker of the type using an arc extinguishing compressed fluid, in particular a gas, such as sulphur hexafluoride, comprising within a tightly sealed casing filled with the extinguishing fluid, a current bearing connector with a stationary contact, a current bearing connector in which a movable contact actuated by a driving mechanism is guided, a fluid blasting device formed by a piston solid with the movable contact and defining a compression zone, and by a fluid blasting nozzle of insulating material brought by the movable contact to an advanced position relatively to the stationary contact with an opening communicating with said compression zone, as well as a body of insulating material for the closure of the blasting nozzle, slidingly mounted for a stroke limited by a stop element on the stationary contact and under the action of elastic means, said movable body being suitable to be moved, so as to go away from said stop element by means of said nozzle during the movable contact closure stroke, characterized in that said movable body is provided with a cavity forming a chamber open towards said blasting nozzle, said chamber of the movable body being placed in communication with said compression zone through said blasting nozzle in that part of the stroke of movable contacts in which the blasting nozzle holds the movable body away from said stop element, whilst the opening of said chamber is facing the opening of the nozzle during the residual part of the stroke of movable contacts.

2. Electrical circuit breaker according to claim 1, characterized in that the movable body is guided on the stationary contact by means of a central sleeve of insulating material, and said inner chamber of the movable body has an annular shape around said guide sleeve.

3. Electrical circuit breaker as claimed in claim 2, characterized in that the inner guide sleeve has such a length, that in the position of the movable body leaning against said stop element, it leaves free the end only of the stationary contact.

4. Electrical circuit breaker as claimed in claim 2, characterized in that the inner guide sleeve has such a length, that in the position of the movable body leaning against said stop element, it leaves free an end portion of the stationary contact.

5. Circuit breaker as claimed in claim 1, characterized in that the end wall of the movable body facing towards the blasting nozzle has a convergent outside surface suitable to cooperate with a corresponding divergent inner surface of the opening of the blasting nozzle.

6. Circuit breaker as claimed in claim 1, characterized in that said movable body has an end wall facing towards the blasting nozzle with its outer surface perpendicular to the axis of the nozzle, suitable to cooperate with an end wall of the nozzle perpendicular to its axis, said end walls of the movable body and of the nozzle leaving centrally free the respective outlet openings.

7. Circuit breaker as claimed in claim 1, characterized in that the end wall of the movable body facing towards the blasting nozzle has a convergent inner surface.

8. Circuit breaker as claimed in claim 1, characterized in that said contacts are respectively stationary and mobile arc contact, and that additional main contacts respectively stationary and movable are provided, positioned in such a way as to surround the movable body mounted on the stationary arc contact as well as the blasting nozzle solid with the movable assembly formed by the movable arc contact, the movable main contact, and the compressing piston.

* * * * *